US005553921A

United States Patent [19]

Schenk

[11] Patent Number: 5,553,921

[45] Date of Patent: Sep. 10, 1996

[54] COLLAPSIBLE BACKREST, AND METHODS OF CONSTRUCTING AND UTILIZING SAME

[76] Inventor: Leonard G. Schenk, 6716 Gulick Rd., Naples, N.Y. 14512

[21] Appl. No.: 491,728

[22] Filed: Jun. 19, 1995

[51] Int. Cl.[6] ..... A47C 15/00; A47D 1/10

[52] U.S. Cl. ..... 297/352; 297/377; 297/252; 5/634; 5/633

[58] Field of Search ..... 297/352, 377, 297/252; 5/633, 634

[56] References Cited

U.S. PATENT DOCUMENTS

| | | | |
|---|---|---|---|
| 374,804 | 12/1887 | Nicholas | 5/634 |
| 691,224 | 1/1902 | Wilkins | 5/634 |
| 849,451 | 4/1907 | Zane | 297/352 |
| 1,209,808 | 12/1916 | Burgess . | |
| 1,363,697 | 12/1920 | Vieira . | |
| 1,447,486 | 3/1923 | Schafer . | |
| 1,540,725 | 6/1925 | Glaser . | |
| 2,108,531 | 2/1938 | Flanders . | |
| 2,322,147 | 6/1943 | Landauer | 297/377 X |
| 2,777,138 | 1/1957 | Gallagher | 5/634 X |
| 3,101,972 | 8/1963 | Laughlin | 297/377 |
| 3,171,687 | 3/1965 | Jensen | 297/377 |
| 3,293,669 | 12/1966 | Emery | 297/377 X |
| 3,334,944 | 8/1967 | Gould et al. | 297/377 |
| 3,423,773 | 1/1969 | Yamate | 297/377 |
| 3,452,372 | 7/1969 | Emery | 5/634 |
| 3,556,587 | 1/1971 | Rymes | 297/377 X |
| 3,746,390 | 7/1973 | Koah | 297/377 X |
| 5,127,422 | 7/1992 | Colón | 297/377 X |

FOREIGN PATENT DOCUMENTS

| | | | |
|---|---|---|---|
| 247592 | 10/1963 | Australia | 297/377 |
| 448367 | 6/1936 | United Kingdom | 5/634 |

*Primary Examiner*—Peter M. Cuomo
*Assistant Examiner*—Rodney B. White
*Attorney, Agent, or Firm*—Weiner, Carrier & Burt, P.C.; William F. Esser; Irving M. Weiner

[57] ABSTRACT

A portable backrest for a picnic bench or bleacher. The backrest includes a back-engaging member having a substantially U-shaped frame; support posts for supporting the back-engaging member in any of a plurality of upright positions; and a clamping mechanism for urging the two prongs of the U-shaped frame against the bench or bleacher for securement thereto.

20 Claims, 1 Drawing Sheet

COLLAPSIBLE BACKREST, AND METHODS OF CONSTRUCTING AND UTILIZING SAME

BACKGROUND OF THE INVENTION

1. Field of Invention

This invention relates to a collapsible backrest device, and particularly to a portable, collapsible backrest for use with a picnic table or other bench.

2. Description of the Relevant Art

There are known backrests. For example, Vieira U.S. Pat. No. 1,363,697 discloses a folding backrest for use in sitting on lawns, beaches, etc. The Vieira reference, however, fails to disclose a portable backrest which secures to a picnic table bench for use therewith.

Flanders U.S. Pat. No. 2,108,531 discloses a portable seat which is adapted for use with benches or bleachers, but provides limited space due to diagonal support bars 12 disposed on either side of the person seated in the seat, provides no adjustable backrest support when associated with a bench, and provides no resistance to forward movement of the seat.

Schafer U.S. Pat. No. 1,447,486 discloses a beach chair but fails to disclose a portable seat which attaches to a picnic table or bench plank.

Burgess U.S. Pat. No. 1,209,808 discloses a beach chair, but fails to disclose an adjustable backrest which securely attaches to a picnic table, bench, or bleacher.

SUMMARY OF THE INVENTION

The present invention overcomes the above-discussed limitations and shortcomings of known portable backrests and satisfies a significant need for a portable, collapsible backrest which securely engages with a picnic table bench or other bench so as to provide support for a person seated thereon.

According to the present invention, there is provided a portable backrest comprising a back-engaging panel formed by a substantially U-shaped frame and material connected between the two prongs thereof; a support structure for adjustably supporting the panel member in one of a plurality of angular positions relative to the bench; a clamping device for securely attaching the backrest to the bench; and wherein the back-engaging panel member, the support structure and the clamping device are connected to each other in such a manner that the backrest is substantially collapsible for convenient transport or storage.

In use, the backrest is slid over the bench. Next, the back-engaging panel is adjusted to the desired angular position relative to the bench. Thereafter, the clamping device is activated so as to secure the backrest to the bench. The secured backrest is positioned laterally across the bench so that a user thereof may be comfortably seated and rest her legs and feet on the bench.

When not in use, these steps are repeated in reverse order so as to disconnect and collapse the backrest for storage or transport.

It is an object of the invention to provide a portable backrest which securely engages with a picnic table bench or similar article so as to substantially restrict any movement relative thereto.

It is another object of the invention to provide such a backrest having means for adjusting the backrest in a plurality of positions.

A further object of the present invention is to provide a portable backrest which attaches to a picnic table bench or similar article in such a manner so as to allow support for the user's feet and legs by the bench.

Another object of the present invention is to provide a backrest which substantially collapses for convenient storage or transport.

Still another object of the present invention is to provide a backrest which is simple in design and inexpensive to manufacture.

Other objects, advantages and salient features of the present invention will become apparent from the following detailed description, which, when taken in conjunction with the annexed drawings, discloses preferred embodiments of the present invention.

DETAILED DESCRIPTION OF THE INVENTION

Figure 1:
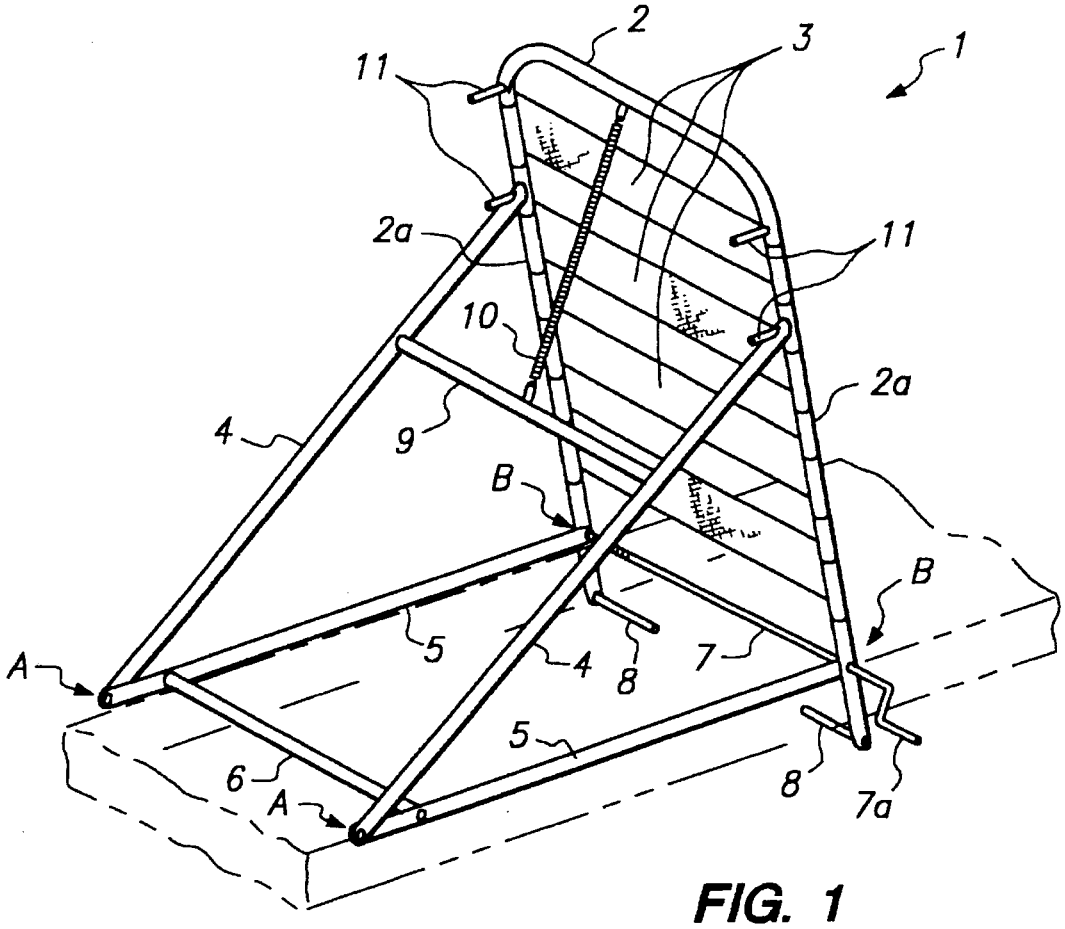
FIG. 1 is a perspective view of a preferred embodiment of the present invention in its operable position.
Figure 2:
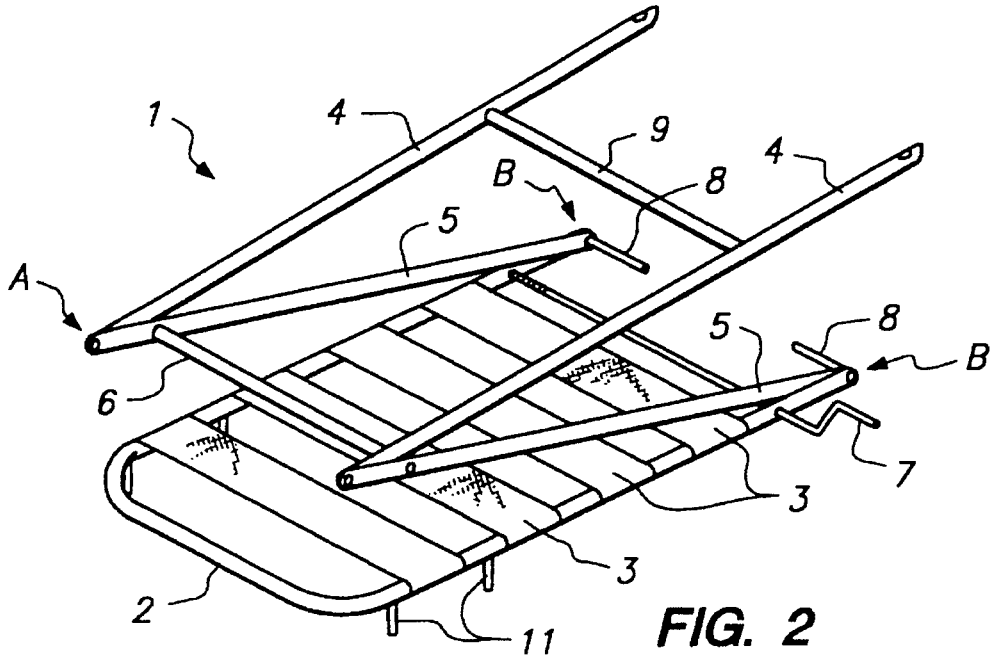
FIG. 2 is a perspective view of a preferred embodiment of the present invention in its collapsed, inoperable position for storage.

Referring to FIGS. 1 and 2, there is shown a portable backrest 1 comprising back-engaging panel 2, 3; diagonal support posts 4; clamp crank 7; adjustment tabs 11; biasing spring 10; and plank extension members 8.

The frame members of the portable backrest 1, most notably members 2 and 4–9 are preferably but not necessarily made from a lightweight, rigid, inexpensive and substantially weather resistant composition, such as steel, heavy aluminum, fiberglass, or extruded plastic. Alternatively, such frame members are constructed from other materials.

The portable backrest according to the preferred embodiments of the present invention includes a panel for comfortably engaging and supporting the user's back and neck region, comprising frame member 2 and lateral supports 3. Frame member 2 is preferably but not necessarily shaped as a substantially inverted "U", having two substantially parallel prongs **2*a*. Frame member 2 is preferably sized and constructed so that prongs 2*a*** are slightly resiliently movable at their free ends.

Lateral supports 3 are preferably connected between prongs **2*a* of frame member 2 and substantially equally spaced therealong. Lateral supports 3 are preferably but not necessarily tightly connected between prongs 2*a* so as to provide comfortable support to the user's back. The number of lateral supports 3 depends in part upon the width of each lateral support 3 and the length of prongs 2*a*. Lateral supports 3** are preferably but not necessarily constructed from a resilient, weather resistant material such as canvas or thinly cut plastic.

The preferred embodiment of the present invention includes a means for supporting the back-engaging panel in an upright position. As shown in FIG. 1, the supporting means preferably but not necessarily comprises diagonal panel support posts 4, longitudinal posts 5, and lateral post 6. Each longitudinal post 5 has a first end which is connected to a prong **2*a* near the free end thereof, and a second end which is pivotally connected to one end of a diagonal support post 4 (FIG. 1). The second end of each diagonal support post 4 preferably but not necessarily engages with a prong 2***a* proximal to the top portion of frame 2, so that the back-engaging panel is supported in an upright position and is substantially resistant to backward movement due to pressure exerted thereon while in use. Lateral post 6 is connected between longitudinal posts 5 at the rearward end thereof, so that post 6 rests on top of the bench plank in order to support the backrest thereover.

According to the present invention, the backrest preferably but not necessarily includes a means for adjusting the angular position of the back-engaging panel member relative to the bench to which the backrest is connected. The adjusting means preferably but not necessarily includes a plurality of tab members 11, each of which extends outwardly from U-shaped frame 2 in a backwardly direction and is aligned with a corresponding tab member 11 disposed along the opposite prong 2*a*, as shown in FIG. 1; and an aperture defined through the end portions of each diagonal support post 4 and sized so as to slidably engage with tab members 11. In this way, the user can selectively engage diagonal support posts 4 with a desired pair of tab members 11 so that the back-engaging panel member is positioned at the desired angle for supporting the user.

The preferred embodiment of the present invention further includes means for selectively securing the backrest to a plank, such as a picnic table bench or a bleacher, in a substantially fixed position. As shown in FIG. 1, the securing means preferably but not necessarily comprises a clamping device which urges prongs 2*a* of frame member 2 substantially inwardly against the substantially vertical sides of the bench plank. The clamping device preferably includes elongated crank 7 having one end which is threaded and a second end which is formed as a handle. Crank 7 is slidably inserted through a first prong 2*a* and threadingly engages with the second prong 2*a*, so that by manually rotating handle 7*a*, the second prong 2*a* moves inwardly towards the first prong 2*a* along crank 7. When the bench plank is positioned between prongs 2*a* (FIG. 1), the inward movement of one prong 2*a* towards the other prong 2*a* acts to substantially clamp frame 2 to the bench plank.

The backrest device according to the present invention preferably but not necessarily includes extension members 8, which extend inwardly from each free end of prongs 2*a*, so that the bench plank fits between prongs 2*a*, the central portion of crank 7, and extension members 8 (FIG. 1).

The backrest preferably but not necessarily includes means for substantially maintaining engagement between the back-engaging panel and diagonal support posts 4. As shown in FIG. 1, the engagement maintaining means comprises second lateral post 9, which is connected between diagonal support posts 4 at a substantially central portion therealong; and spring member 10, which is connected between second lateral post 9 and substantially U-shaped frame 2. Spring member 10 urges frame member 2 towards diagonal support posts 4 so that the engagement between tab members 11 and posts 4 is maintained. The tension of spring member 10 is preferably but not necessarily set so that such engagement is maintained while allowing frame member 2 to easily disengage from diagonal supports 4 by manual effort in order to adjust the operable position of the panel member or collapse the backrest for storage and/or transport.

The pivotal connections A between diagonal supports 4 and longitudinal supports 5, and the pivotal connections B between frame member 2 and longitudinal supports 5 provide collapsibility to the backrest. When collapsed, frame 2 and diagonal posts 4 are each substantially collapsed along longitudinal posts 5, as shown in FIG. 2.

In use, the backrest is first slid into position along the bench or bleacher so that the bench is located between extension members 8, the central portion of crank 7, and prongs 2*a* (FIG. 1). Next, the back-engaging panel is adjusted to the desired angle by engaging the apertures of diagonal posts 4 with the appropriate pair of tab members 11. Then spring member 10 is connected between second lateral post 9 and frame 2. The clamping device is then activated so as to firmly secure the backrest to the bench by manually rotating crank 7 so that the free ends of prongs 2*a* are brought towards each other and sufficiently squeeze the longitudinal edges of the bench, until the backrest is substantially locked into position. Thereafter, the backrest is positioned relative to the bench so that a person may sit on the bench, lean against the backrest and rest her feet on the bench.

The backrest is easily readjusted to another inclined position relative to the bench by manually lifting frame 2 away from diagonal posts 4 until tab members 11 are disengaged therefrom, and then engaging posts 4 with the appropriate tab members 11.

The backrest is collapsed for storage or transport by first releasing the engagement between the backrest and the bench through rotation of crank 7 until the end portions of prongs 2*a* are sufficiently separated so that the backrest can be easily slid out from the bench. Next, spring member 10 is disconnected from second lateral support 9. Then the engagement between frame member 2 and diagonal posts 4 is released. Thereafter, frame member 2 and diagonal posts 4 are pivoted about connections B and A, respectively, until they are substantially collapsed against longitudinal posts 5.

Although there has been described what is at present considered to be the preferred embodiments of the present invention, it will be understood that the invention can be embodied in other specific forms without departing from the spirit or essential characteristics thereof.

The described embodiments are, therefore, to be considered in all aspects as illustrative, and not restrictive. The scope of the invention is indicated by the appended claims rather than the foregoing description.

I claim:

1. A portable backrest for a bench, comprising:

a panel member;

means, connected to said panel member, for supporting said panel member in a substantially upright position;

means, connected to said panel member and said support means, for selectively clamping said backrest onto a plank of the bench;

means for selectively adjusting an angular position of said panel member relative to the bench;

wherein the bench plank includes an upper surface and two longitudinal sides adjacent either longitudinal edges of the plank upper surface, and wherein said panel member includes a substantially inverted U-shaped frame member having a plurality of longitudinal prongs which are positioned above the bench plank with end portions of said prongs extending substantially adjacent either longitudinal side of the bench plank; and wherein said clamping means extends between said longitudinal prongs and secures said frame member substantially laterally across the upper surface of the bench plank by squeezing said longitudinal frame prongs towards each other and inwardly against either longitudinal side of the bench plank so that said frame member is positioned substantially laterally over the upper surface of the bench plank.

2. A backrest as recited in claim 1, wherein:

said clamping means comprises an elongated crank which is slidably received by an end portion of a first prong of said inverted U-shaped frame and threadingly engages with an end portion of a second prong thereof so that rotation of said crank moves said second prong relative to said first prong.

3. A backrest as recited in claim 2, wherein:

said panel member includes a plurality of extension members, each of which is connected to an end of said longitudinal frame prongs and extends laterally inwardly in a substantially perpendicular relationship therewith; and said backrest engages with the bench plank by sliding said backrest thereon so that the bench plank is positioned between said crank, said first and said second prongs, and said extension members.

4. A backrest as recited in claim 1, wherein:

said supporting means comprises a plurality of longitudinal post members, each of which includes a first end which attaches to an end portion of one of said prongs and extends rearwardly of said panel member and longitudinally along the bench plank, a first lateral post member which is attached between said longitudinal post members proximal to a second end of each of said longitudinal post members, and a plurality of diagonal post members, each of which has a first end which attaches to said second end of one of said longitudinal post members and a second end which engages with said substantially U-shaped frame member.

5. A backrest as recited in claim 4, wherein:

said adjusting means comprises a plurality of tab members disposed along said prongs of said substantially U-shaped frame member, each tab member extending substantially outwardly therefrom in a substantially rearward direction and in substantial alignment with a corresponding tab member on another prong, and wherein said second ends of said diagonal post members include an aperture defined therethrough for slidably engaging with said tab members.

6. A backrest as recited in claim 5, further including:

means for urging said substantially U-shaped frame member in substantially secure engagement with said diagonal post members.

7. A backrest as recited in claim 6, wherein:

said urging means comprises a second lateral member positioned between said diagonal post members at a substantially central location therealong, and a spring member having a first end which is attached to said second lateral member and a second end which is attached to said substantially U-shaped frame member.

8. A backrest as recited in claim 7 wherein:

said connection between said longitudinal post members and said substantially U-shaped frame is a pivotal connection, said connection between said longitudinal post members and said diagonal post members is a pivotal connection, and said connection between said spring member and said second lateral member is selectively removable so that said backrest is substantially collapsible.

9. A backrest for a picnic table bench, comprising:

a back support member;

means, associated with said back support member, for maintaining said back support member in an upright position;

means, connected to said back support member, for selectively securing said backrest in a substantially fixed position laterally across the bench;

wherein the bench comprises a plank having an upper surface and two substantially vertical longitudinal sides adjacent thereto;

wherein a portion of said back support member extends below the bench plank along either substantially vertical longitudinal side thereof;

said securing means pinches said free ends of said prongs against the substantially vertical longitudinal sides of the bench plank;

said back support member includes a substantially inverted U-shaped post having two elongated prongs, each of said prongs having a free end which selectively extends adjacent the substantially vertical longitudinal sides of the bench plank; and said securing means includes a threaded member which is engaged with each of said prongs so as to selectively pinch said free ends of said prongs against the substantially vertical longitudinal sides of the bench plank so that said back support member is positioned substantially laterally across an upper surface of the bench.

10. A backrest as recited in claim 9, wherein:

said threaded member of said securing means comprises a crank member which slidably engages with an end portion of a first prong and having a threaded first end which adjustably engages with an end portion of a second prong so that rotation of said crank member moves an end of said second prong relative to an end of said first prong.

11. A backrest as recited in claim 10, wherein:

each of said prongs of said back support member includes an extension member disposed at a free end thereof, each extension member extending substantially inwardly towards each other; and the bench is slidably received between a central portion of said crank member, said prongs and said extension members.

12. A backrest as recited in claim 9, wherein:

said maintaining means comprises a pair of first post members, each of which has a first end which is connected to a prong and extends rearwardly therefrom; a pair of diagonal members, each having a first end which pivotally attaches to a second end of one of said first post members and a second end which selectively engages with said back support member; and a first lateral member which extends between said first post members proximal to said second ends thereof.

13. A backrest as recited in claim 12, further including:

means for selectively adjusting an inclined position of said back support member relative to the bench.

14. A backrest as recited in claim 13, wherein:

said adjusting means comprises a plurality of tab member pairs which rearwardly extend from said prongs in a linear relationship therealong, and wherein said diagonal members each include an aperture for slidably engaging with one of said tab members.

15. A backrest as recited in claim 14, further including:

means for substantially maintaining engagement between said tab members and said diagonal members.

16. A backrest as recited in claim 16, further including:

a second lateral member disposed between said diagonal members;

wherein said engagement maintaining means comprises a spring member connected between said second lateral member and said back support member so as to urge said back support member towards said diagonal members.

17. A seating device, comprising:

a plank;

means, connected to said plank, for supporting a person's back; and wherein said back supporting means includes a means for positioning said back supporting means laterally to said plank and selectively clamping said back supporting means into position thereover;

said back supporting means includes a backrest member;

said plank is elongated having an upper surface and two substantially vertical longitudinal surfaces adjacent either longitudinal edge of said upper surface;

said backrest member includes a frame member having ends which extend downwardly adjacent said substantially vertical longitudinal surfaces;

said clamping means includes a threaded member which engages with each of said ends of said frame member so that said threaded member selectively urges said ends of said frame member against said substantially vertical longitudinal surfaces of said plank.

18. A seating device as recited in claim 17, wherein:

said threaded member comprises an elongated crank member having a threaded end; and said threaded end of said crank member engages with said frame member so that manual rotation of said crank member urges said ends of said frame member against said substantially vertical longitudinal surfaces of said plank.

19. A device as recited in claim 17, further including:

at least one longitudinal post member having a first end which pivotally engages with a lower portion of said backrest member; and at least one diagonal post member having a first end which pivotally engages with a second end of said longitudinal post member, and a second end which selectively engages with an upper portion of said backrest member.

20. A device as recited in claim 19, further including:

means, connected to said backrest member, for maintaining engagement between said backrest member and said at least one diagonal post member.

* * * * *